US008867317B2

(12) United States Patent
Sano et al.

(10) Patent No.: US 8,867,317 B2
(45) Date of Patent: Oct. 21, 2014

(54) ELECTRONIC DEVICE AND RADIO TIMEPIECE INCLUDING ANTENNA

(75) Inventors: Takashi Sano, Fussa (JP); Yoshihiko Enta, Saitama (JP)

(73) Assignee: Casio Computer Co., Ltd., Tokyo (JP)

( * ) Notice: Subject to any disclaimer, the term of this patent is extended or adjusted under 35 U.S.C. 154(b) by 338 days.

(21) Appl. No.: 13/488,762

(22) Filed: Jun. 5, 2012

(65) Prior Publication Data

US 2012/0320717 A1 Dec. 20, 2012

(30) Foreign Application Priority Data

Jun. 15, 2011 (JP) ..... 2011-132802

(51) Int. Cl.
*G04B 43/00* (2006.01)
*H01Q 1/27* (2006.01)

(52) U.S. Cl.
CPC ..... *H01Q 1/273* (2013.01)
USPC ..... 368/47; 368/293

(58) Field of Classification Search
USPC ..... 368/14, 47, 293; 343/718, 720
See application file for complete search history.

(56) References Cited

U.S. PATENT DOCUMENTS

| | | | | |
|---|---|---|---|---|
| 6,531,988 | B1 | 3/2003 | Koyama | |
| 6,992,952 | B2 * | 1/2006 | Endo et al. | 368/10 |
| 7,158,449 | B2 * | 1/2007 | Fujimori et al. | 368/47 |
| 7,345,957 | B2 * | 3/2008 | Nirasawa | 368/47 |
| 7,355,556 | B2 * | 4/2008 | Abe et al. | 343/788 |
| 8,345,514 | B2 * | 1/2013 | Sumida et al. | 368/47 |
| 8,467,272 | B2 * | 6/2013 | Fujisawa | 368/47 |
| 2004/0145975 | A1 * | 7/2004 | Barras et al. | 368/281 |
| 2009/0201771 | A1 | 8/2009 | Miyahara | |
| 2010/0060540 | A1 | 3/2010 | Abe | |
| 2011/0051561 | A1 | 3/2011 | Fujisawa | |

FOREIGN PATENT DOCUMENTS

| | | | |
|---|---|---|---|
| JP | 10-197662 | A | 7/1998 |
| JP | 2010-273231 | A | 12/2010 |

OTHER PUBLICATIONS

Extended European Search Report (EESR) dated Oct. 15, 2012 (in English) issued in counterpart European Application No. 12170824.2.

* cited by examiner

*Primary Examiner* — Sean Kayes
(74) *Attorney, Agent, or Firm* — Holtz, Holtz, Goodman & Chick PC

(57) ABSTRACT

An electronic device includes a circuit substrate, an antenna, an electronic component or a terminal, and a shield pattern. The antenna includes: a core having a length direction; and a coil part including a conducting wire wound around the core, and is disposed on a first side of the substrate in such a way that the length direction is nearly parallel to the first side. The electronic component or the terminal is disposed on a second side of the substrate in such a way as to correspond to the antenna. The shield pattern is disposed on and/or in the substrate between the antenna and the electronic component or the terminal. The length of a part of the shield pattern, the part overlapping with the antenna, is shorter than the length of the coil part.

11 Claims, 7 Drawing Sheets

ELECTRONIC DEVICE AND RADIO TIMEPIECE INCLUDING ANTENNA

BACKGROUND OF THE INVENTION

1. Field of the Invention

The present invention relates to an electronic device and a radio timepiece each including an antenna.

2. Description of the Related Art

Conventionally, there is known an electronic device, such as a radio timepiece, including an antenna which receives a standard radio wave including time information, so as to automatically correct current time.

As the antenna which receives a standard radio wave including time information, for example, a bar antenna is often used, the bar antenna having a coil part formed by winding a conducting wire around a core made of a high-permeability magnetic material, such as an amorphous metal or ferrite.

However, when a component made of a metallic material, such as an electronic component or a ground pattern constituted of a copper foil, is disposed near the antenna, loss (eddy current loss) is caused thereby, and sensitivity (reception) of the antenna degrades.

Furthermore, when a terminal (for example, a terminal for checking, a check terminal hereinbelow) or an electronic component handling signals, the HIGH and LOW of which are switched at high speed, is disposed near the antenna, the sensitivity of the antenna degrades by being influenced by noise generated from the terminal or the electronic component.

Japanese Patent Application Laid-Open Publication No. 2010-273231 proposes cutting apart of a circuit substrate, the part including the circumference of the circuit substrate, so as to make a side part, and disposing an antenna on the side part of the circuit substrate.

With this configuration, an antenna can be some distance away from a component made of a metallic material, a terminal generating noise, or an electronic component, so that the sensitivity of the antenna can be prevented from degrading.

However, recently, an electronic device such as a radio watch has been having more functions. In order to realize various functions, it has been necessary to place many electronic components and/or terminals, such as a detection IC, a time microcomputer and various mechanical components, on a circuit substrate. In this point, the technology disclosed by Japanese Patent Application Laid-Open Publication No. 2010-273231 has a problem that because a space to dispose an antenna is secured by cutting a part of a circuit substrate, the area of the circuit substrate for placing electronic components and the like (packaging area) becomes small.

On the other hand, if an attempt is made to secure a large packaging area of a circuit substrate, the packaging area being for placing electronic components and the like, while bad influence from the electronic components or terminals on an antenna is avoided, it is necessary to dispose the antenna outside the circuit substrate. As a result, the size of an electronic device as a whole is increased.

Furthermore, Japanese Patent Application Laid-Open Publication No. hei 10-197662 (corresponding to U.S. patent application Ser. No. 08/997,405, abandoned) discloses a technology to dispose an electromagnetic shielding layer in the middle of a circuit wiring substrate on which an antenna is disposed.

However, when an electromagnetic shielding layer is disposed in the middle of a circuit wiring substrate on which an antenna is disposed, the sensitivity of the antenna becomes bad depending on a positional relationship between the antenna and the electromagnetic shielding layer.

BRIEF SUMMARY OF THE INVENTION

The present invention is made in view of the circumstances, and an object of the present invention is to provide an electronic device which can secure a large packaging area of a circuit substrate without degrading sensitivity of an antenna, and can be miniaturized as a whole.

In order to achieve at least one object described above, according to an aspect of the present invention, there is provided an electronic device including: a circuit substrate; an antenna including (i) a core having a length direction and (ii) a coil part including a conducting wire wound around the core, the antenna being disposed on a first side of the circuit substrate in such a way that the length direction of the core is nearly parallel to the first side of the circuit substrate; an electronic component or a terminal disposed on a second side of the circuit substrate in such a way as to correspond to the antenna; and a shield pattern disposed on the circuit substrate and/or in the circuit substrate between the antenna and the electronic component or the terminal, wherein a length of apart of the shield pattern in the length direction, the part overlapping with the antenna, is shorter than a length of the coil part of the antenna in the length direction.

DETAILED DESCRIPTION OF THE INVENTION

In the following, referring to FIGS. 1 to 7, an electronic device in accordance with an embodiment of the present invention is described. In the embodiment, the electronic device is applied to a radio watch including an antenna. However, the electronic device of the present invention is not limited to a radio watch.

Figure 1:
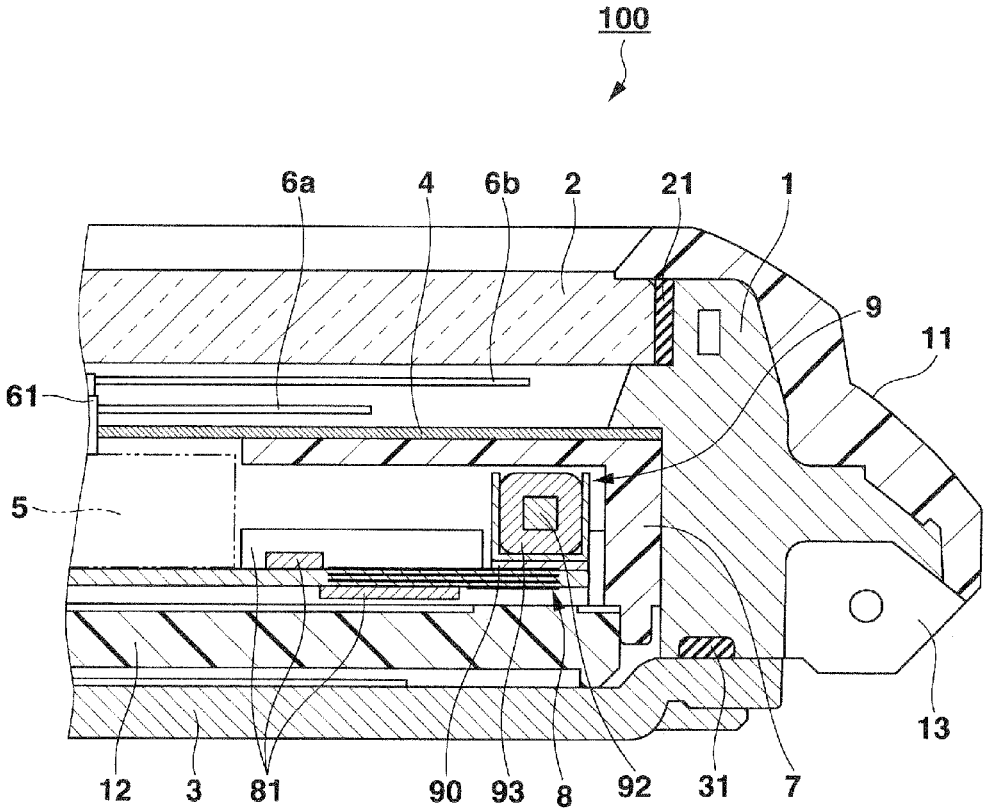
FIG. 1 is an enlarged sectional view showing the main part of an electronic device in accordance with an embodiment of the present invention, the electronic device being applied to a radio watch.

FIG. 1 is an enlarged sectional view showing the main part of a radio watch in accordance with the embodiment.

A radio watch 100 in the embodiment electrically drives hands (an hour hand, a minute hand, and the like) so as to rotate the hands, thereby displaying time.

The radio watch 100 includes a main body case (a watch case 1, hereinbelow) formed in the shape of a short column. In the embodiment, the watch case 1 is made of, for example, a metallic material such as stainless or titanium. The watch case 1 is not necessary to be made of a metallic material, and may be made of resin or the like. A bezel 11 made of soft resin is attached to the circumference on the upper side (front side) of the watch case 1.

Strap attachment parts 13 where a watchstrap (not shown) is attached are formed at points on the outer surface of the watch case 1, the points which correspond to points for twelve o'clock and six o'clock of the radio watch 100. A plurality of operation buttons (not shown) and the like to input various operation instructions, such as an instruction to adjust time, are provided on the side part of the watch case 1.

As shown in FIG. 1, the watch case 1 is open at its upper part and lower part (the upper side and the lower side in FIG. 1) so that the inside thereof is hollow. The hollow functions as a housing part to provide a space to house various components.

A windshield 2 made of a transparent material such as glass is attached to an opening part on the front side (a front-side opening part) of the watch case 1 (a visual confirmation side, the upper side in FIG. 1) so as to close/cover the front-side opening part via a waterproof ring 21 or the like.

In addition, a back-side cover 3 is attached to an opening part on the back side (a back-side opening part) of the watch case 1 (the lower side in FIG. 1) so as to close/cover the back-side opening part via a waterproof ring 31 or the like.

A dial plate 4 is disposed under the windshield 2 in the watch case 1. On the dial plate 4, not-shown time-indicating characters and the like are disposed.

Near the center of the dial plate 4, a not-shown through-hole is provided. Shafts 61 are inserted into the through-hole so as to pass through the through-hole from the inner mechanism side of a timepiece movement 5 to the front side of the radio watch 100 (the visual confirmation side having the windshield 2 thereon, the upper side in FIG. 1). The shafts 61 respectively support the hands (an hour hand 6*a*, a minute hand 6*b*, and the like). The shafts 61 are connected to not-shown hand drive motors via not-shown gear train mechanisms. When the hand drive motors are driven to rotate their corresponding shafts 61, the hands respectively supported by the shafts 61 point at the time-indicating characters, which are disposed along the circumference of the dial plate 4, so that time is displayed.

A housing 7 made of resin or the like is disposed under the dial plate 4 in the watch case 1. In the housing 7, the timepiece movement 5, a circuit substrate 8 having various electronic components, and the like are housed. The timepiece movement 5 moves the hands such as the hour hand 6*a*, the minute hand 6*b*, and the like. The timepiece movement 5 includes the gear train mechanisms, the hand drive motors, and the like. The hands (6*a*, 6*b*, and the like) and the timepiece movement 5 constitute a time display section.

Under the housing 7, a supporter 12 which supports the housing 7 is disposed.

Figure 2:
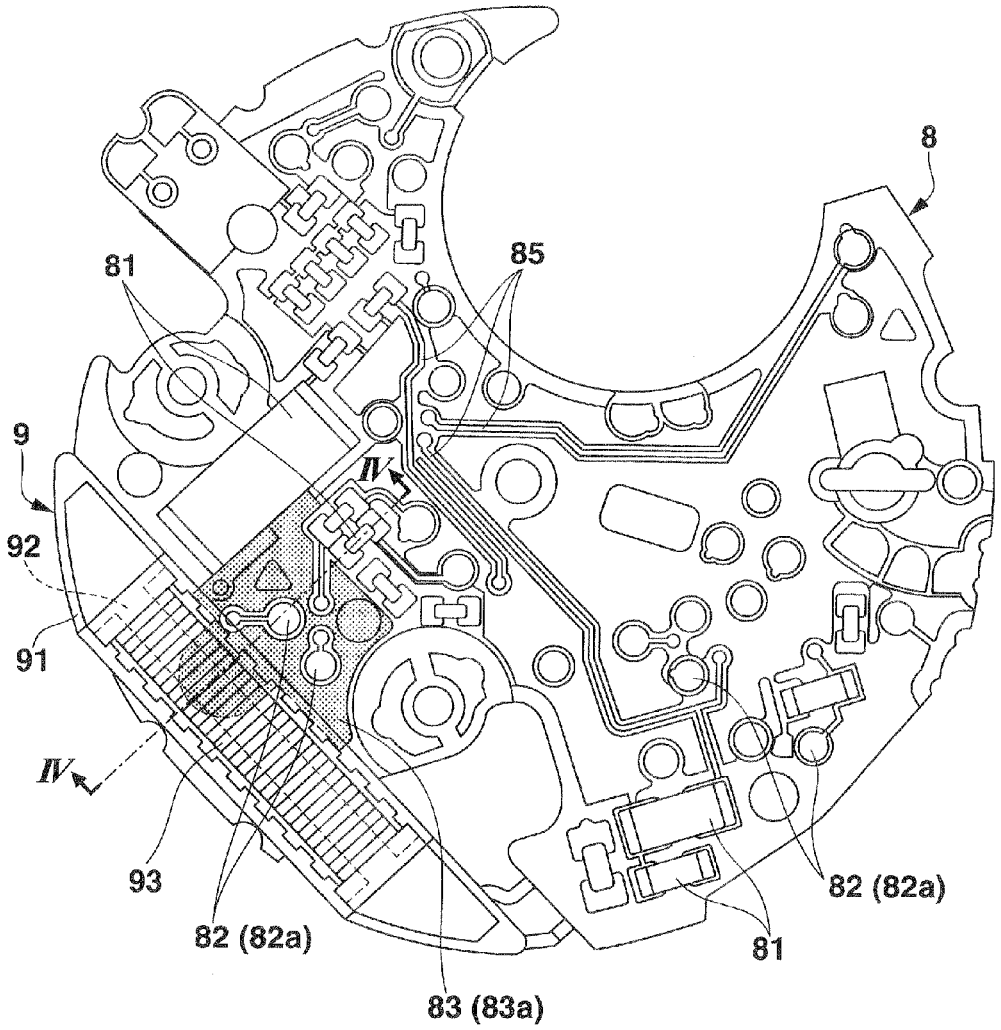
FIG. 2 is an enlarged plan view showing the front side of a circuit substrate of the radio watch shown in FIG. 1.
Figure 3:
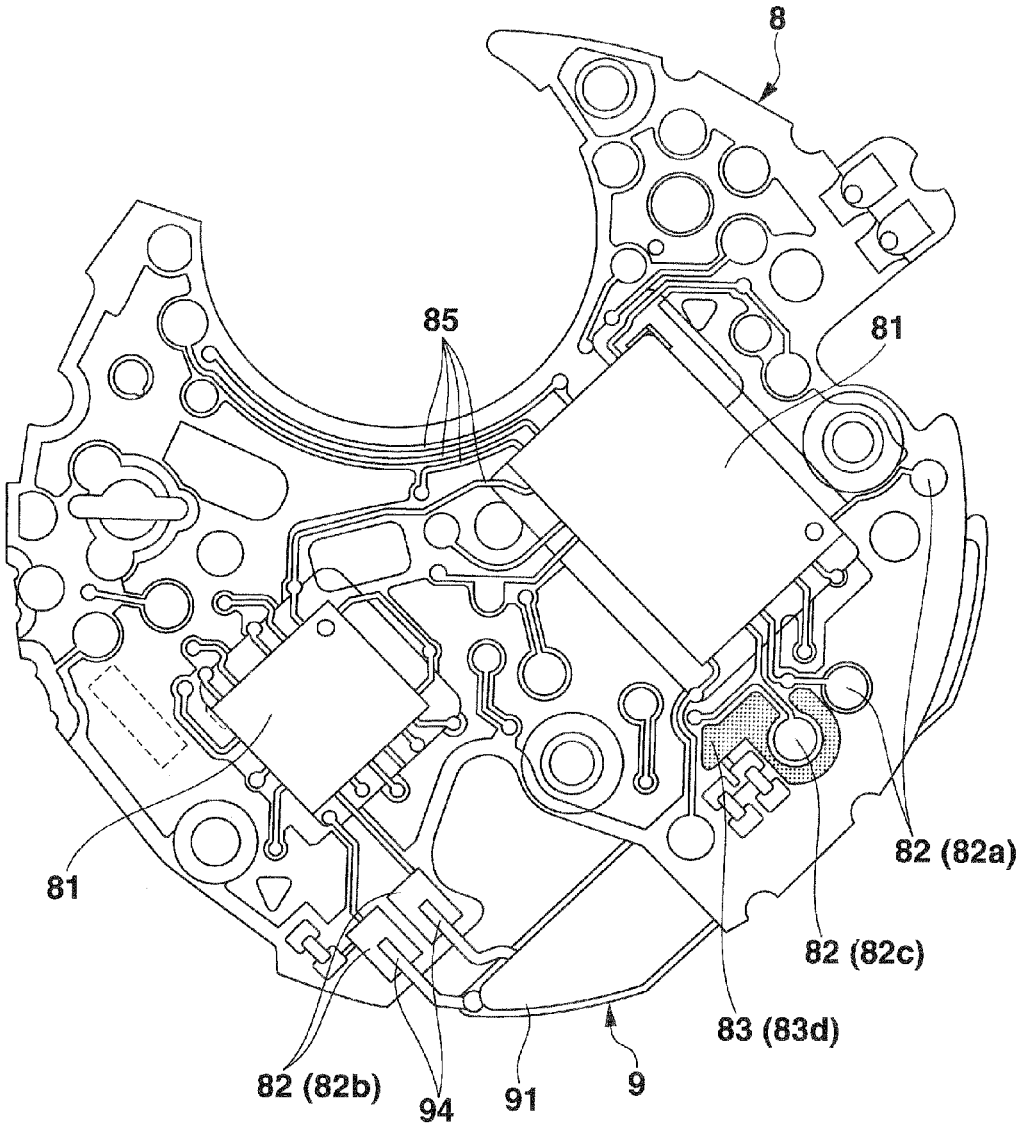
FIG. 3 is an enlarged plan view showing the back side of the circuit substrate shown in FIG. 2.
Figure 4:
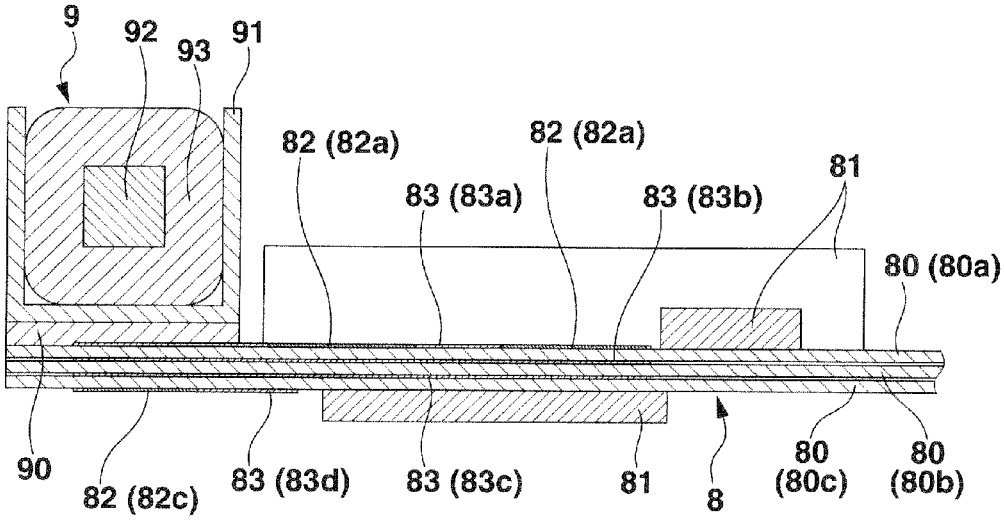
FIG. 4 is a sectional view taken along the line IV-IV of FIG. 2.

FIG. 2 is a plan view of the circuit substrate 8 in the embodiment viewed from the front side thereof (the visual confirmation side, the upper side in FIG. 1). FIG. 3 is a plan view of the circuit substrate 8 viewed from the back side thereof (the lower side in FIG. 1). FIG. 4 is a sectional view taken along the line IV-IV of FIG. 2.

In the embodiment, as shown in FIGS. 2 and 3, the circuit substrate 8 is formed to be approximately disc-shaped as a whole.

As shown in FIG. 2, on the front side which is one side (a first side) of the circuit substrate 8 (the visual confirmation side, the upper side in FIG. 1), various electronic components 81 are disposed. The electronic components 81 are, for example, a semiconductor element such as an LSI (Large Scale Integrated circuit), a capacitor, and the like.

On the front side of the circuit substrate 8, circuit patterns 85 which electrically connect the electronic components 81 with each other are formed. In addition, a plurality of terminals 82 (common terminals 82*a*) connected with the electronic components 81 and the like is formed by patterning.

At a part on the front side of the circuit substrate 8, the part including the circumference of the circuit substrate 8, an antenna 9 housed in a case 91 is disposed. The antenna 9 is fixed onto the circuit substrate 8, for example, with an adhesive argent 90. The method for fixing the antenna 9 onto the circuit substrate 8 is not limited to the fixation using an adhesive agent. Furthermore, it is not necessary to house the antenna 9 in the case 91. The antenna 9, which is not housed in a case, may be directly disposed on the circuit substrate 8.

In the embodiment, the antenna 9 includes a core 92 and a coil part 93. The core 92 is long in a length direction. The coil part 93 is formed by winding a conducting wire around the core 92. When a radio wave penetrates the core 92, an induced current is generated in the coil part 93.

The core 92 is made of a magnetic material such as ferrite or amorphous. The material of the core 92 is not limited to ferrite or amorphous. As long as the material is a magnetic material which can be processed to be in the shape of the core 92, another material can be used.

The antenna 9 is disposed on the one side (the first side) of the circuit substrate 8 in such a way that the length direction of the circuit substrate 8 is nearly parallel to the one side of the circuit substrate 8.

As shown in FIG. 3, on the back side which is the other side (a second side) of the circuit substrate 8 (the lower side in FIG. 1), various electronic components 81 are disposed. The electronic components 81 are, for example, a reception circuit which amplifies and/or demodulates electrical signals detected by a quartz resonator or the antenna 9 to take out time data included in a standard radio wave, a timer circuit which measures current time and includes an oscillator, and a capacitor (all not shown). Furthermore, circuit patterns 85 which electrically connect the electronic components 81 with each other are formed on the back side of the circuit substrate 8.

In addition, on the back side of the circuit substrate 8, a plurality of terminals 82 (common terminals 82*a*) connected with the electronic components 81 and the like is formed by patterning.

Furthermore, in the vicinity of a point on the back side of the circuit substrate 8, the point corresponding to the position of the antenna 9 on the front side thereof, a pair of terminals (fixation terminals) 82*b* to which the antenna 9 is connected and fixed is disposed. Both ends of the conducting wire extracted from the coil part 93 are pulled to the backside of the circuit substrate 8, and fixed to the fixation terminals 82*b*, respectively.

Furthermore, in the embodiment, at a point on the back side of the circuit substrate 8, the point corresponding to the position of the coil part 93 of the antenna 9 on the front side thereof, a check terminal (check pad) 82*c* is disposed. The check terminal 82*c* handles signals, the HIGH and LOW of which are switched at high speed, and generates noise which influences the sensitivity of the antenna 9.

In the embodiment, the circuit substrate 8 is a multilayered substrate in which three insulating layers 80 (80*a* to 80*c*) are laminated. Shield patterns 83 (83*a* to 83*d*) are disposed on the circuit substrate 8 and in the circuit substrate 8 (namely, between the insulating layers 80 (80*a* to 80*c*)) between the antenna 9 disposed on the front side of the circuit substrate 8 and an electronic component(s) 81 or a terminal(s) 82 (the check terminal 82*c*, for example) disposed on the back side thereof.

The shield patterns 83 are solid patterns constituted of films or foils made of a metallic material such as copper. The method for forming the shield patterns 83 is not particularly limited. For example, screen printing, PVP (Physical Vapor Deposition), photolithography using a photoresist, or the like can be used.

The shield patterns 83 are formed at the same time as the circuit patterns 85 and the terminals 82 are formed.

Referring to FIGS. 2 to 5D, the shield patterns 83 in the embodiment are described in detail.

In the embodiment, as shown in FIG. 4, four shield patterns 83 are disposed, namely, one on the front side of the circuit substrate 8, one on the back side thereof, one between the insulating layers 80*a* and 80*b* (on an inner layer), and one between the insulating layers 80*b* and 80*c* (on an inner layer).

In the embodiment, all the shield patterns 83*a* to 83*d* are directly connected to a ground (GDN), so-called solid ground patterns.

Figure 5A:
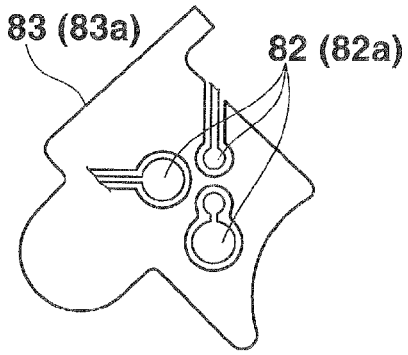
FIG. 5A is a plan view of a first shield pattern disposed on the front side of the circuit substrate shown in FIG. 1.

FIG. 5A is a plan view of the shield pattern 83 (the first shield pattern 83*a*) formed on the front side of the circuit substrate 8 (namely, on the front side of the first insulating layer 80*a*).

As shown in FIGS. 3 and 4, in the embodiment, at the point on the back side of the circuit substrate 8, the point corresponding to the position of the coil part 93, the check terminal 82*c* is disposed. The shield pattern 83*a* has a shielding part which is approximately semicircular on the front side of the circuit substrate 8. The shielding part is provided in such a way as to correspond to the terminal 82*c* and the vicinity thereof. As described above, on the circuit substrate 8, the plurality of terminals 82 (common terminals 82*a*) connected with the electronic components 81 and the like is formed. The shield pattern 83*a* is disposed in such a way as to avoid the terminals 82*a*.

The shape of the shield pattern 83*a* is not limited to the shape shown in FIG. 5A or described herein.

Figure 5B:
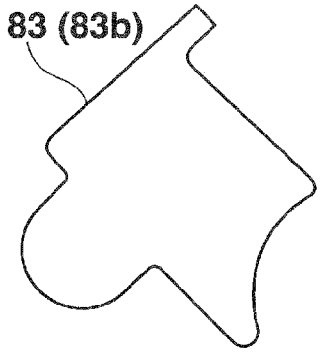
FIG. 5B is a plan view of a second shield pattern disposed on an inner layer of the circuit substrate shown in FIG. 1.

FIG. 5B is a plan view of the shield pattern 83 (the second shield pattern 83*b*) formed between the first insulating layer 80*a* and the second insulating layer 80*b*.

Figure 5C:
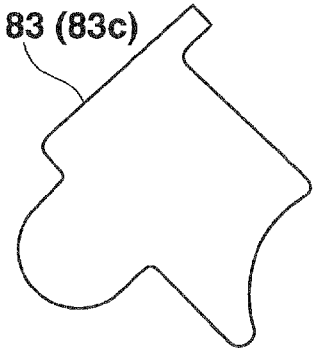
FIG. 5C is a plan view of a third shield pattern disposed on an inner layer of the circuit substrate shown in FIG. 1.

FIG. 5C is a plan view of the shield pattern 83 (the third shield pattern 83*c*) formed between the second insulating layer 80*b* and the third insulating layer 80*c*.

The external shapes of the second shield pattern 83*b* and the third shield pattern 83*c* are almost the same as the external shape of the first shield pattern 83*a*. As shown in FIG. 4, the first to third shield patterns 83*a* to 83*c* are laminated so as to be disposed at almost the same position in a thickness direction of the circuit substrate 8.

The shapes of the second shield pattern 83*b* and the third shield pattern 83*c* are not limited to the shapes shown in FIGS. 5B and 5C or described herein, and the external shapes thereof may be different from the external shape of the first shield pattern 83*a*, for example.

Figure 5D:
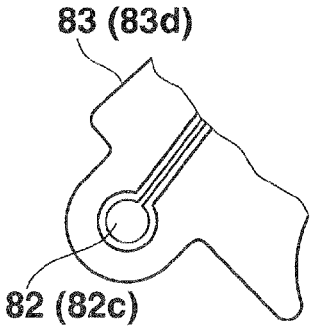
FIG. 5D is a plan view of a fourth shield pattern disposed on the back side of the circuit substrate shown in FIG. 1.

FIG. 5D is a plan view of the shield pattern 83 (the fourth shield pattern 83*d*) formed on the back side of the circuit substrate 8 (namely, on the back side of the third insulating layer 80*c*).

The fourth shield pattern 83*d* is disposed in such a way as to enclose the check terminal 82*c*, which is disposed at a point on the back side of the circuit substrate 8, the point corresponding to the position of the coil part 93.

The shape of the fourth shield pattern 83*d* is not limited to the shape shown in FIG. 5D or described herein, and the external shape thereof may be almost the same as the external shapes of the shield patterns 83*a* to 83*c*, for example.

As described above, on the circuit substrate 8, the terminals 82 such as the check terminal 82*c*, which generates noise causing the sensitivity of the antenna 9 to degrade, and the electronic components 81 are placed. However, in the embodiment, the shield patterns 83 are laminated and disposed between the terminal(s) 82 or the electronic component(s) 81 and the antenna 9. Consequently, even when the check terminal 82*c* or the like is disposed at a point on the back side of the circuit substrate 8, the point corresponding to the position of the coil part 93 of the antenna 9, the antenna 9 is not influenced by the noise generated from the terminal 82 or the electronic component 81. Accordingly, the sensitivity of the antenna 9 can be prevented from degrading.

In general, when a component made of a metallic material is disposed near the antenna 9, the loss is caused, and the sensitivity of the antenna 9 degrades. However, as long as a component made of a metallic material is disposed within a predetermined region with respect to a positional relationship between the component and the antenna 9, the sensitivity of the antenna 9 does not degrade much owing to the loss.

Figure 6:
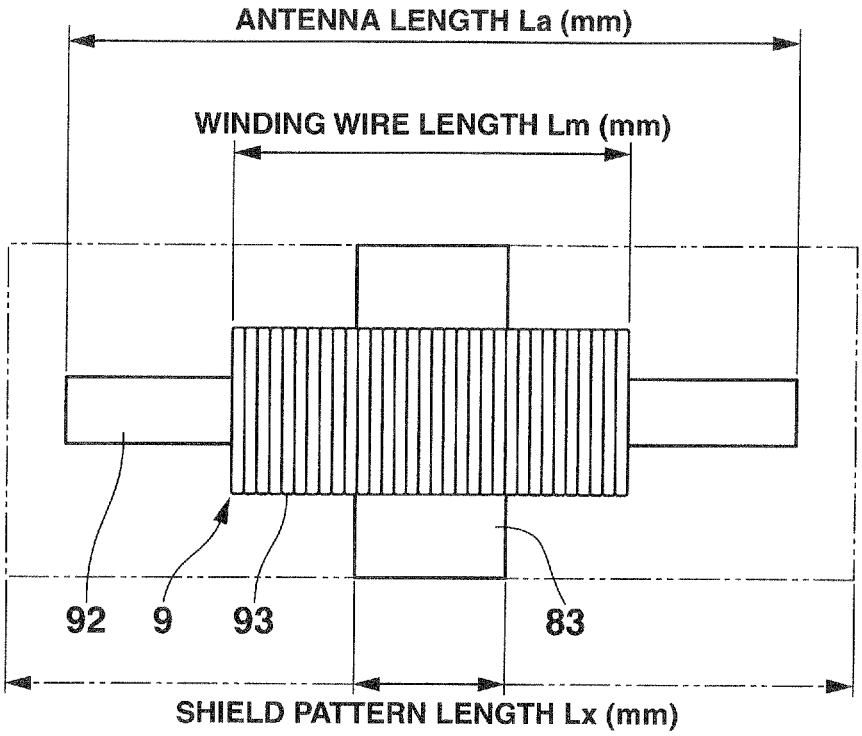
FIG. 6 is an illustration for explaining where the shield patterns are disposed with respect to an antenna.
Figure 7:
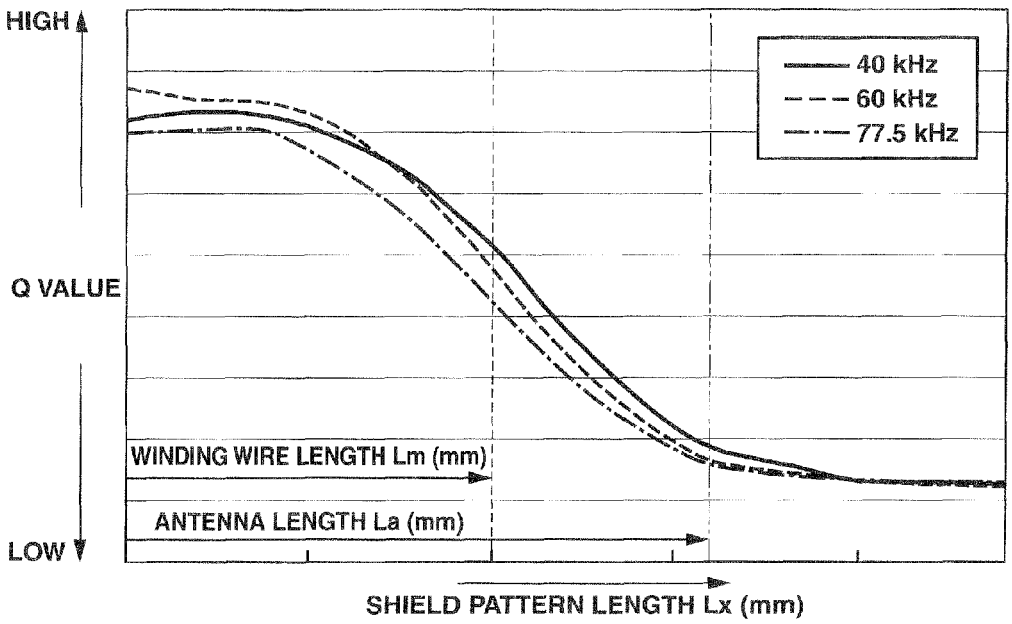
FIG. 7 is a graph showing a relationship between the disposition of the shield patterns and the Q (Quality Factor) value of the antenna.

This respect is described referring to FIGS. 6 and 7.

FIG. 7 is a graph obtained by measuring the value of Q (Quality Factor) in a case where the antenna 9 and the shield patterns 83 constituted of copper foils are disposed as shown in FIG. 6, and the antenna 9 receives radio waves having frequencies of 40 kHz, 60 kHz and 77.5 kHz, which are main frequencies of standard radio waves received by a radio watch. The Q value indicates how small the loss is as an indicator of the sensitivity of the antenna 9. The higher the Q value is, the less the loss is, and the less the sensitivity of the antenna 9 degrades, accordingly.

In FIG. 6, the length of the antenna 9 in the extending direction of the core 92 (i.e. in the length direction) is an antenna length La, the length of the coil part 93 in the antenna length La direction (i.e. in the length direction) is a winding wire length Lm, and the length of the shield patterns 83 in the extending direction of the antenna 9 (i.e. in the length direction) is a shield pattern length Lx. In the case where, with respect to the length direction, a region of the shield patterns 83 is within a region of the coil part 93, and accordingly the shield pattern length Lx is shorter than the winding wire length Lm of the coil part 93, the Q value, which indicates how small the loss is as an indicator of the sensitivity of the antenna 9, does not decrease much (i.e. the Q value is high) as shown in FIG. 7. According to FIG. 7, around the point where, with respect to the length direction, the region of the shield patterns 83 starts to go beyond the region of the coil part 93, and accordingly the shield pattern length Lx is about to be longer than the winding wire length Lm, the decrease of the Q value becomes large (i.e. the Q value starts to be low). Around the point where, with respect to the length direction, the region of the shield patterns 83 is almost the same as a region of the antenna 9, and accordingly the shield pattern length Lx is almost the same as the antenna length La, the decrease of the Q value becomes the largest (i.e. the Q value is lowest), and even when the shield pattern length Lx is made to be longer than the antenna length La, the Q value does not decrease any more.

Accordingly, in the case where, with respect to the length direction, the region of the shield patterns 83 is within the region of the coil part 93, and accordingly the shield pattern length Lx is shorter than the winding wire length Lm, the sensitivity of the antenna 9 does not degrade much owing to the loss, and noise can be blocked by the shield patterns 83.

Next, operations of the radio watch 100 in the embodiment are described.

The circuit substrate 8 of the radio watch 100 in the embodiment is formed as follows. The first shield pattern 83*a*, various terminals 82, various circuit patterns 85, and the like are formed on the front side of the first insulating layer 80*a*. The second shield pattern 83*b* is formed between the first insulating layer 80*a* and the second insulating layer 80*b*. The third shield pattern 83*c* is formed between the second insulating layer 80*b* and the third insulating layer 80*c*. The fourth shield pattern 83*d*, the check terminal 82*c*, other various terminals 82, various circuit patterns 85, and the like are formed on the back side of the third insulating layer 80*c*. The insulating layers 80*a* to 80*c* are laminated successively. Thus, the circuit substrate 8 is formed.

In addition, the antenna 9 is fixed on the front side of the circuit substrate 8 with the adhesive agent 90 in such a way that the coil part 93 is disposed over the shield pattern 83*a*. The shield pattern 83*a* is disposed at a point corresponding to the position of the check terminal 82*c*, which is disposed on the back side of the circuit substrate 8. Various electronic components 81 are placed on the front side and the back side of the circuit substrate 8. The circuit substrate 8 including the antenna 9 is housed in the housing 7, and the housing 7 housing the circuit substrate 8 is housed in the watch case 1.

When the radio watch 100 receives a standard radio wave, magnetic-field components of the radio wave penetrate the windshield 2, the dial plate 4, and the like which are nonconductive members made of a material not shielding radio waves, so as to enter the core 92 of the antenna 9. Magnetic flux, which enters the antenna 9 from one side of the core 92, passes through the antenna 9 so as to come out from the other side of the core 92. While the magnetic flux passes through the antenna 9, an alternating current (AC) is induced (induced current) in the coil part 93 wound around the core 92, and accordingly an AC voltage is generated at both ends of the coil part 93. The AC voltage is transmitted to the not-shown reception circuit as analog received signals. Even when noise is generated from the check terminal 82*c* or the like at this point of time, the noise is blocked by the shield patterns 83*a* to 83*d*, so that the antenna 9 does not pick up the noise, and transmits only the signals based on the standard radio wave to the reception circuit.

Then, the reception circuit performs processing, such as amplification, demodulation and/or decoding, on the analog received signals, so as to obtain distal time data. Current time is corrected as needed on the basis of the obtained time data, and an accurate current time is displayed (indicated) by the hands of the radio watch 100.

As described above, according to the embodiment, the shield patterns 83 are disposed between the antenna 9 and the electronic component(s) 81 or the terminal(s) 82. Accordingly, the antenna 9 can be prevented from being influenced by the noise generated from the electronic component 81 or the terminal 82 placed on the circuit substrate 8. Accordingly, even when the antenna 9 is disposed on the front side (or the back side) of the circuit substrate 8 in such a way as to correspond to the electronic component 81 or the terminal 82 disposed on the back side (or the front side) thereof, the sensitivity of the antenna can be prevented from degrading.

Because the antenna 9 and the electronic component 81 or the terminal 82 can be respectively disposed on the front side and the back side of the circuit substrate 8 in such a way as to correspond to each other, a large packaging area of the circuit substrate 8 can be secured, packaging efficiency (packaging density) can be increased, and the radio watch 100 can be miniaturized as a whole.

In the embodiment, the circuit substrate 8 is formed by laminating the multiple insulating layers 80*a* to 80*c*, and the shield patterns 83 are disposed between the first insulating layer 80*a* and the second insulating layer 80*b*, and between the second insulating layer 80*b* and the third insulating layer 80*c*, in the circuit substrate 8. Accordingly, the noise generated from the check terminal 82*c* or the like disposed on the back side of the circuit substrate 8 can be blocked more certainly, and the sensitivity of the antenna 9 can be prevented from degrading.

Because each of the shield patterns 83 is connected to a ground, generation of noise can be prevented.

As described above, even when a component made of metal is disposed near the antenna 9, as long as the region of the component made of metal is within the region of the coil part 93 with respect to the length direction, and accordingly the length of the component is shorter than the length of the coil part 93, the sensitivity of the antenna 9 does not degrade much. In the embodiment, the shield patterns 83 are disposed within the region of the coil part 93 with respect to the length direction, and accordingly disposed in such a way that the length of the shield patterns 83 in the extending direction of the antenna 9 (i.e. in the length direction) is shorter than the length of the coil part 93 of the antenna 9 in the length direction. Consequently, the loss caused by disposing the shield patterns 83 is reduced. Accordingly, the noise can be blocked while the sensitivity of the antenna 9 is prevented from degrading.

By disposing the shield patterns 83 within the region of the coil part 93 with respect to the length direction, and accordingly disposing the shield patterns 93 in such a way that the length of the shield patterns 83 in the length direction is shorter than the length of the coil part 93 in the length direction, the electronic component 81, the terminal 82 or the like which generates noise can be disposed on the back side of the circuit substrate 8 in such a way as to correspond to the antenna 9 disposed on the front side thereof. Accordingly, the degree of freedom in placing (packaging) components and the like on the circuit substrate 8 can be increased.

In the embodiment, the antenna 9 is disposed on a side of the circuit substrate 8, the side where the timepiece movement 5 including the gear train mechanisms to move the hands of the analog radio watch 100 is disposed. Consequently, as long as the antenna 9 having the height being the same as or lower than the height of the timepiece movement 5 is used, even when the antenna 9 is disposed on the circuit substrate 8, the size of the radio watch 100 as a whole in the thickness direction does not become larger thereby. Accordingly, components can be efficiently placed without making a device larger.

In the embodiment, the shield patterns 83 are disposed in order to block noise generated from the check terminal 82*c* in particular. However, the shield patterns 83 are not disposed in order to block noise generated only from the check terminal 82*c*.

For example, in a case where an electronic device (the radio watch 100 or the like) includes a liquid crystal display section constituted of a liquid crystal panel or the like as a time display section, a terminal to which drive signals of the liquid crystal panel are outputted, a terminal which is connected with a power source system to turn on the liquid crystal panel, and the like easily generate noise which influences the sensitivity of the antenna 9 because these terminals handle signals, the HIGH and LOW of which are switched at high speed.

Therefore, in this case, it is preferable to dispose a shield pattern(s) 83 at points corresponding to the positions of these terminals too so as to block the noise.

In the embodiment, the circuit substrate 8 is a multilayered circuit substrate in which three insulating layers are laminated. However, this is not a limit. For example, the circuit substrate 8 may be a single-layer circuit substrate or a multilayered circuit substrate in which four or more layers are laminated.

In the embodiment, four shield patterns 83 are disposed, namely, one on the front side (i.e. one side or the first side) of the circuit substrate 8, one on the backside (i.e. the other side or the second side) thereof, and two between the insulating layers 80 (on inner layers) thereof. However, the number of the shield patterns 83 is not limited thereto.

For example, the shield pattern (s) 83 may be disposed only on the front side and/or the back side of the circuit substrate 8, or may be disposed only between the insulating layers 80 of the circuit substrate 8. In the case where the circuit substrate 8 has a multilayered structure like the embodiment, it is not necessary to dispose the shield patterns 83 between respective insulating layers 80, namely, on all inner layers. For example, the shield pattern 83 may be disposed only between the first insulating layer 80*a* and the second insulating layer 80*b*.

However, it is preferable to dispose a plurality of the shield patterns 83 in order to effectively block noise generated from the electronic component 81 or the terminal 82.

In the embodiment, the shield patterns 83 formed at a point corresponding to the position of the antenna 9 have shapes suitable for the check terminal 82*c* disposed on the back side of the circuit substrate 8. However, the point where the shield patterns 83 are disposed and the shapes of the shield patterns 83 are not limited to the point and shapes described herein.

As shown in FIG. 7, when foils or films made of a metallic material such as the shield patterns 83 are disposed within the region of the coil part 93 with respect to the length direction, the Q value does not decrease much. Hence, as long as the shield patterns 83 are disposed within the region of the coil part 93 of the antenna 9 with respect to the length direction, and accordingly disposed in such a way that the length of the shield patterns 83 in the extending direction of the antenna 9 (i.e. in the length direction) is shorter than the length of the coil part 93 of the antenna 9 in the length direction, the shield patterns 83 may be disposed all over the region of the coil part 93.

In a case where some degradation of the sensitivity of the antenna 9 is acceptable, the shield patterns 83 may be disposed in such a way as to go beyond the region of the coil part 93 with respect to the length direction.

In the embodiment, the shield patters 83 are disposed at only one part of the circuit substrate 8, the part corresponding to the antenna 9 and the vicinity thereof. However, the part thereof where the shield patterns 83 are disposed and how many parts thereof the shield patterns 83 are disposed are not particularly limited. As long as the parts are parts which do not influence the sensitivity of the antenna 9, the shield patterns 83, namely, the solid patterns made of a metallic material such as copper foils, may be disposed at other parts on the circuit substrate 8 or in the circuit substrate 8 (on inner layers) too.

In the embodiment, each of the shield patterns 83*a* to 83*d* is connected to a ground. However, it is not necessary to connect the shield patterns 83 to a ground. The shield patterns 83 may be shield patterns not connected to a ground.

Alternatively, only one or some of the shield patterns 83*a* to 83*d* may be connected to a ground.

In the embodiment, the radio watch 100 is an analog radio watch having hands. However, the radio watch 100 is not limited thereto. For example, the radio watch 100 may be a digital radio watch 100 having a liquid crystal display section constituted of a liquid crystal panel or the like, or may be a radio watch 100 having hands and a liquid crystal display section.

In the case where the radio watch 100 has a liquid crystal display section constituted of a liquid crystal panel or the like, as described above, it is preferable to dispose the shield patterns 83 at points corresponding to the terminal to which drive signals of the liquid crystal panel are outputted, the terminal which is connected with a power source system to turn on the liquid crystal panel, or the like, in order to block noise.

In the embodiment, the radio watch 100 is described as the electronic device. However, the electronic device is not limited to a radio watch, and can be applied to various radio timepieces, such as a travel watch, an alarm clock, a table clock and a wall clock. In addition, the electronic device is not limited to a radio timepiece, and can be applied to various electronic devices, such as a mobile phone.

Needless to say, the present invention is not limited to the embodiment, and hence can be appropriately modified.

In the above, an embodiment of the present invention is described. However, the scope of the present invention is not limited to the embodiment described above, and hence includes the scope of claims attached below and equivalences thereof.

This application is based upon and claims the benefit of priority under 35 USC 119 of Japanese Patent Application No. 2011-132802 filed on Jun. 15, 2011, the entire disclosure of which, including the description, claims, drawings, and abstract, is incorporated herein by reference in its entirety.

What is claimed is:

1. An electronic device comprising:

a circuit substrate with electronic components being disposed thereon and having a first front surface side and a second back surface side;

an antenna including (i) a core having a length direction and (ii) a coil including a conducting wire wound around the core and having a winding wire length along the length of direction of the core, the antenna being disposed on the first front surface side of the circuit substrate in such a way that the length direction of the core is nearly parallel to the first front surface side of the circuit substrate;

an electronic component or a terminal disposed on the second back surface side of the circuit substrate in such a way as to correspond with a position of the coil of the antenna on the first front surface side; and a shield pattern disposed on the circuit substrate and/or in the circuit substrate between the antenna and the electronic component or the terminal;

wherein a side length of the shield pattern in the length direction of the core of the antenna is shorter than the winding wire length of the coil in the core length direction and is within a region of the winding wire length.

2. The electronic device according to claim 1, wherein the circuit substrate includes multiple insulating layers being laminated, and the shield pattern includes at least one shield pattern disposed between any two of the insulating layers in the circuit substrate.

3. The electronic device according to claim 1, wherein the shield pattern is connected to a ground.

4. The electronic device according to claim 1, wherein the terminal is disposed on the second back surface side of the circuit substrate in such a way as to correspond with the position of the coil of the antenna on the first front surface side, and the shield pattern is disposed on the second back surface side in such a way as to enclose the terminal.

5. The electronic device according to claim 1, wherein the shield is formed with a circuit pattern on the circuit substrate.

6. A radio timepiece which receives a standard radio wave including time information so as to correct time, the radio timepiece comprising:

a circuit substrate with electronic components being disposed thereon and having a first front surface side and a second back surface side; and an antenna which receives the standard radio wave, the antenna including (i) a core having a length direction and (ii) a coil including a conducting wire wound around the core and having a winding wire length along the length direction of the core, the antenna being disposed on the first front surface side of the circuit substrate in such a way that the length direction of the core is nearly parallel to the first front surface side of the circuit substrate, wherein an electronic component or a terminal is disposed on the second back surface side of the circuit substrate in such a way as to correspond with a position of the coil of the antenna on the first front surface side, wherein a shield pattern is disposed on the circuit substrate and/or in the circuit substrate between the antenna and the electronic component or the terminal, and wherein a side length of the shield pattern in the length direction of the core of the antenna is shorter than the winding wire length of the coil in the core length direction and is within a region of the winding wire length.

7. The radio timepiece according to claim 6, wherein the circuit includes multiple insulating layers being laminated, and the shield pattern includes at least one shield pattern disposed between any two of the insulating layers in the circuit substrate.

8. The radio timepiece according to claim 6, wherein the shield pattern is connected to a ground.

9. The radio timepiece according to claim 6, wherein the terminal is disposed on the second back surface side of the circuit substrate in such a way as to correspond with the position at the coil of the antenna on the first front surface side, and the shield pattern is disposed on the second back surface side in such a way as to enclose the at least one terminal.

10. The radio timepiece according to claim 6, wherein the shield pattern is formed with a circuit pattern on the circuit substrate.

11. The radio timepiece according to claim 6, further comprising:

a time display section which displays time; and a case which houses the time display section, the circuit substrate and the antenna, the case being wearable on a wrist.

* * * * *

UNITED STATES PATENT AND TRADEMARK OFFICE

CERTIFICATE OF CORRECTION

PATENT NO. : 8,867,317 B2
APPLICATION NO. : 13/488762
DATED : October 21, 2014
INVENTOR(S) : Takashi Sano et al.

It is certified that error appears in the above-identified patent and that said Letters Patent is hereby corrected as shown below:

In the Claims

Column 10, Line 42, Claim 1, Line 8:

after "length" delete "of".

Column 10, Line 53, Claim 1, Line 19:

delete "terminal;" and insert --terminal,--.

Column 11, Line 7, Claim 5, Line 2:

after "shield" insert --pattern--.

Column 12, Line 6, Claim 7, Line 2:

after "circuit" insert --substrate--.

Column 12, Line 16, Claim 9, Line 4:

change "at" to --of--.

Signed and Sealed this
Fifth Day of May, 2015

Michelle K. Lee

Michelle K. Lee
*Director of the United States Patent and Trademark Office*